United States Patent [19]

Naumann et al.

[11] 4,441,424

[45] Apr. 10, 1984

[54] CONTROL SYSTEM FOR CONTROLLING REGULATING MEMBERS OF PRINTING MACHINES

[75] Inventors: Johannes Naumann; Wolfgang Pohl, both of Coswig; Karl-Heinz Förster, Dresden, all of German Democratic Rep.

[73] Assignee: Veb Kombinat Polygraph "Werner Lamberz" Leipzig, Leipzig, German Democratic Rep.

[21] Appl. No.: 424,983

[22] Filed: Sep. 27, 1982

Related U.S. Application Data

[63] Continuation-in-part of Ser. No. 405,097, Aug. 4, 1982.

[30] Foreign Application Priority Data

Aug. 4, 1981 [DD] German Democratic Rep. ... 232359

[51] Int. Cl.[3] ..... B41F 13/24

[52] U.S. Cl. ..... 101/248

[58] Field of Search ..... 101/248, 216, 181, 212

[56] References Cited

U.S. PATENT DOCUMENTS 3,623,402 11/1971 Kubilos ..... 135/78 X
3,732,815 5/1973 Greiner et al. ..... 101/216 X
3,841,216 10/1974 Huffman ..... 101/248 X
3,934,505 1/1976 Kushner ..... 101/248 X
3,945,266 3/1976 Dufour ..... 101/248
4,116,125 9/1978 Förster et al. ..... 101/212

FOREIGN PATENT DOCUMENTS 1288829 9/1972 United Kingdom ..... 137/109

*Primary Examiner*—E. H. Eickholt
*Attorney, Agent, or Firm*—Michael J. Striker

[57] ABSTRACT

A control system for a printing machine having a main shaft with a constant ratio of its rotary speed to a drive speed of the printing machine, has a plurality of translationally, continuously rotatably and discontinuously rotatably movable regulating members controllable by a main shaft of the machine, and a single supply system operating by hydraulic energy and associated with the regulating members, wherein the supply system includes a fixed-displacement pump, an oil supply conduit connecting the fixed-displacement pump with the regulating members, an electrically actuated flow regulating valve acting upon an oil stream, and a signal transmitter with a signal processor arranged so that the flow regulating valve connected with the main shaft via the signal processor.

7 Claims, 2 Drawing Figures

CONTROL SYSTEM FOR CONTROLLING REGULATING MEMBERS OF PRINTING MACHINES

CROSS-REFERENCE TO RELATED APPLICATION

This application is a Continuation-in-Part application of our copending application Ser. No. 405,097, filed Aug. 4, 1982 and entitled CONTROL SYSTEM FOR CONTROLLING ADJUSTMENT MEMBERS ON PRINTING PRESSES.

BACKGROUND OF THE INVENTION

The present invention relates to a control system for controlling regulating members in printing machines in which the regulating members perform translatory, continuously rotary or discontinuously rotary regulating movements.

A plurality of regulating movements must be performed in a printing machine and classified in three movement types. In addition to the translatory regulating movements, such as for example the movements of pull guides, sheet separating elements or the transverse movement of the distributing cylinder, rotary movements take place in the printing machine which can be subdivided into continuous and discontinuous rotary movements. The continuous rotary movements include, for example, the main drive of the printing machine and the movement of the inking rollers, whereas the discontinuous rotary movements include, for example, the pressure application and withdrawal movements and the lever drive. For actuating the regulating members, substantially four energy types are utilized. They include mechanical, electrical, hydraulic and pneumatic energy. The mechanical, electrical, hydraulic and pneumatic regulating members must be controlled in correspondence with their movement types, i.e. translatory, continuous rotary and discontinuous rotary, and in correspondence with the energy type used thereby, i.e. mechanical, electrical, hydraulic or pneumatic energy. The control must be carried out so that all regulating movements are performed with a constant ratio relative to a main shaft whose rotary speed always has a constant ratio to the rotary speed of the drive of the printing machine. Several types of control must be utilized. One possibility is that the drive problem is lost in the event of continuous or discontinuous regulating movement in a conventional manner by mechanical positive action. During automation of the printing program, it is necessary to satisfy in increasing degree the requirement of variability of the ratio between the regulating movement of the continuous or discontinuous regulating members and the machine speed. The requirement is satisfied only with the aid of non-centrally controlled drives. The control of such non-centrally controlled device requires high expenditures for controlling elements to sufficiently guarantee the accuracy required for the printing machine. In the event of discontinuous regulating drive, an exact arrangement of the control movement to the machine rotary angle must be controlled. In addition, to controlling connection of the functions of the successively arranged working stations, such as the connection of the movement of the respective regulating members, is necessary. For performing these complex control functions, path scheduling control is provided, which as known is used with shift registers in connection with different mechanical, electrical, pneumatic and hydraulic control elements. The continuous increase of the machine's rotary speed, and thereby increased dynamic requirements, make necessary reduction of the dead time and control time of the discontinuous regulating members, which can be attained only with the aid of expensive electronic compensation circuits. In modern printing machines, there are, as required by progress in automation, a plurality of control types for complex machine controls because of different movement types and different energy types to be used. The control is therefore vague and the coordination between the control types is very complicated.

SUMMARY OF THE INVENTION

Accordingly, it is an object of the present invention to provide a control system for a printing machine, which avoids the disadvantages of the prior art.

More particularly, it is an object of the present invention to provide a control system for a printing machine which allows controlling of regulating members of a printing machine in operationally reliable, uncomplicated and economical manner.

It is also an object of the present invention to provide a control system for a printing machine in which the number of energy types used to control regulating members is reduced, and many of the control types are eliminated because of the utilization of a respective control system.

In keeping with these objects, and with others which will become apparent hereinafter, one feature of the present invention resides in a control system for printing machines having a main shaft with a constant ratio of rotary speed to drive speed of the printing machine, wherein there are a plurality of translational, continuously rotary and discontinuously rotary movable regulating members controllable by the main shaft, and a single supply system is provided operating by hydraulic energy and associated with the regulating members, wherein the supply system includes a fixed-displacement pump, an oil supply conduit connecting the fixed-displacement pump with the regulating members, and electrically actuated flow regulating valves acting upon an oil stream, and a signal transmitter with a signal processor arranged so that the flow regulating valve is connected with the main shaft via the signal processor.

Another feature of the present invention is that the electrically actuated flow regulating valve of the supply system is formed as a flow limiting valve or as a servo valve.

Still another feature of the present invention is that there are a plurality of directional control valves connected with the regulating members, and synchronizing members connected with the directional control valves.

A further feature of the present invention is that the synchronizing members are coupled with cams arranged on the main shaft. The hydraulic regulating members and the synchronizing members are provided with input members.

With the process of automation of the printing machine and thereby utilization of decentralized drive, there arises also the need in a clear, uncomplicated and economically less expensive control. Despite considerable efforts in this field none of the experts have solved this problem to reduce the number of energy types utilized for controlling the regulating members and to eliminate several control types by utilization of a suitable control system. The present invention attains this for the first time. It makes possible, by only one universal supply system, for example by lifting mangets, to carry out the pressure application and withdrawal or the main drive via hydraulic regulating members. Thereby the control is substantially clear, uncomplicated and economically less expensive.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
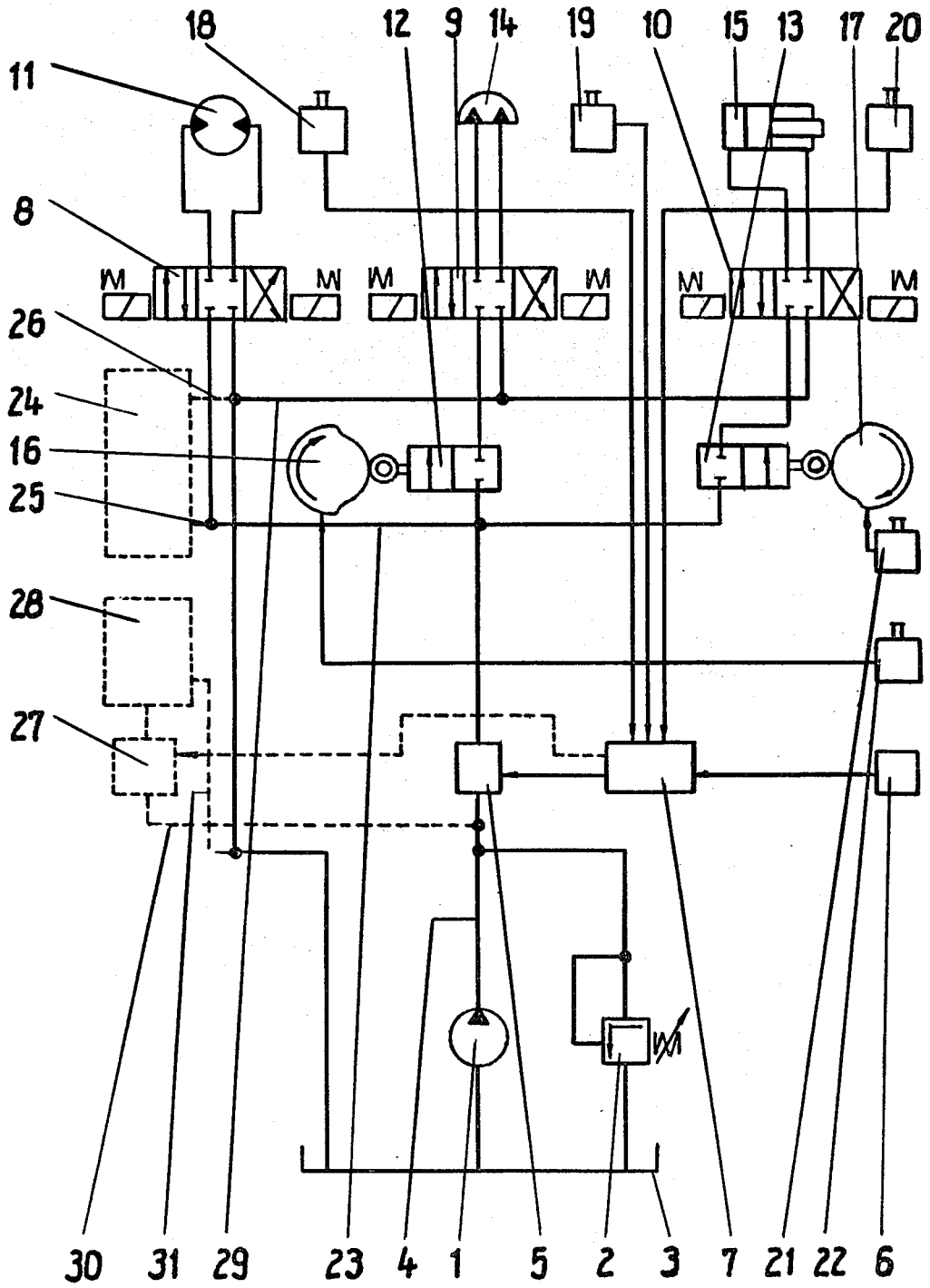
FIG. 1 is a view schematically showing a control system for regulating members in a printing machine.

A control system for a printing machine in accordance with the present invention is shown in FIG. 1. A fixed-displacement pump 1 with a flow regulating valve 2 connected in parallel therewith communicates with an oil supply container 3. The fixed-displacement pump 1 is connected via an oil supply conduit 4 with a flow regulating valve 5. A signal transmitter 6 which is coupled with a not shown main shaft of the printing machine is linked via a signal processor 7 with the flow regulating valve 5. A first directional control valve 8 is connected via a distributing conduit 23 with a hydraulic motor 11. Parallel thereto there are connected a first synchronizing member 12, a second directional valve 9 of a rotary angular motor 14, a second synchronizing member 14, and a third directional control valve 10 of a hydraulic cylinder 15. A first cam 16 is associated with the first synchronizing member 12 and a second cam 17 is associated with the second synchronizing member 13. Both cams 15 and 17 are coupled with the not shown main shaft.

The hydraulic motor 11 is associated with a hydraulic motor input element 18, the rotary angular motor 14 is associated with a rotary angular motor input element 19, and the hydraulic cylinder 15 is associated with a hydraulic cylinder input element 20. The above mentioned input elements 18, 19, 20 are connected with the signal processor 7.

Figure 2:
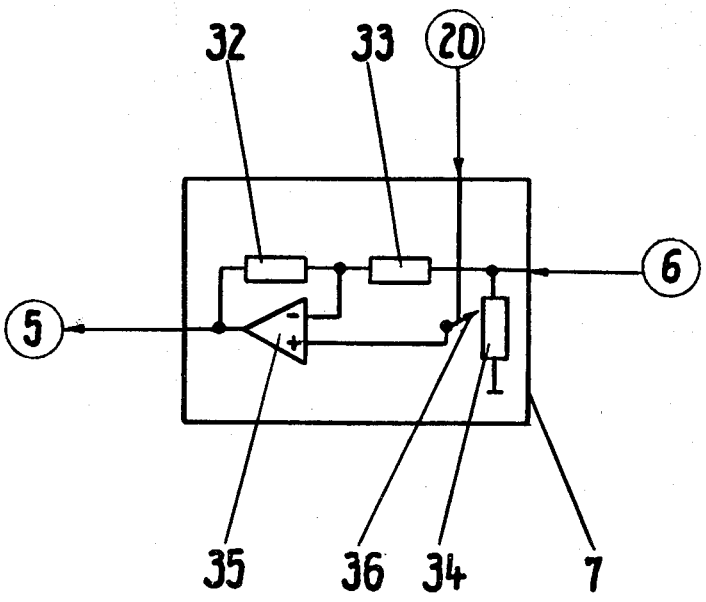
FIG. 2 is a view showing a circuit of a signal processor of the inventive system.

The signal processor 7 is shown in FIG. 2 and includes a first fixed resistor 32 and a second fixed resistor 33 both having the resistance value $R_1$, a potentiometer 34 which has the total resistance value $R_2$ and has the resistance value $R_2$ between its slider 36 and the reference potential, and an operational amplifier 35. The slider 36 of the potentiometer 34 is mechanically adjusted by the hydraulic cylinder input element 20.

A first synchronizing member input element 21 is coupled with the first synchronizing member 12, and a second synchronizing member input element 22 is coupled with the second synchronizing member 13.

For connecting of a further regulating member 24, a conduit 25 extending from the distributing conduit 23 and a branch 26 leading to the oil supply container 3 and connected with an oil discharge conduit 9 are provided. A flow regulating valve 27 is arranged parallel to the flow regulating valve 5 and connected with the oil conduit via an oil supply conduit 30. It is provided with a possible connection 28 for another hydraulic regulating member. A discharge conduit 31 is connected with the oil discharge conduit 29 leading in the oil supply container 3.

The control system in accordance with the present invention operates in the following manner.

Hydraulic oil is supplied from the hydraulic oil supply container 3 by the fixed-displacement pump 1 into the oil conduit 4. The pressure limiting valve 2 connected in parallel with the fixed-displacement pump 1 guarantees the constant pump pressure required for the operation of the circuit. The hydraulic oil flows then through the flow regulating valve 5. The signal transmitter 6 coupled with the main shaft of the printing machine supplies a rotary speed signal to the signal processor 7. The signal processor 7 supplies adjusting command to the flow limiting valve 5 which regulates the throughflow quantity in correspondence with the rotary speed of the machine in such a manner that a not shown adjusting drive of the flow regulating valve 5 changes the throughflow cross section. The thereby adjusted oil stream is supplied to the hydraulic motor 11, rotary angular motor 14, and the hydraulic cylinder 15 and determines their speed, which now corresponds to the rotary speed of the printing machine.

The regulating member supplied only from one flow regulating valve 5 can only individually move the hydraulic motor 11, the rotary angular motor 14, and the hydraulic cylinder 15, inasmuch as the adjusted oil stream from the flow regulating valve 5 flows to the consumer with the minimum incoming pressure. If it is necessary to move simultaneously several consumers, the oil flow regulating valve must be arranged parallel to the individual consumers. In the thus formed circuit, the oil stream flows simultaneously through the oil flow regulating valve and also through connected-in-parallel oil flow regulating valve 27. This connected-in-parallel oil flow regulating valve 27 must also be controlled via the signal transmitter 6 and the signal processor 7. Via the possible connection 28 other consumers can simultaneously be supplied with hydraulic oil.

The flow regulating valve 5 can be formed as a flow limiting valve or a servo valve. For the drive of the hydraulic motor 13 with continuous rotary driven movement, the hydraulic oil leaving the flow regulating valve 5 can be directly supplied via the directional control valve 8 to the hydraulic motor 11. The directional control valve 8 determines the rotary direction of the hydraulic motor 11. The rotary angular motor 14 and the hydraulic cylinder 15, which perform a discontinuous driven movement, are supplied with the hydraulic oil via the synchronizing members 12 and 13 and the directional control valves 9 and 10, inasmuch as here, in addition to the motor speed referred to the printing machine, also exact arrangement of the motor movement to a predetermined machine rotary angle is required. The directional control valves 9 and 10 which determine the direction of the motor movement are actuated in time sequence from the synchronizing members 12 and 13, so that the actual time of the directional control valves cannot affect the beginning of movement of the motors. The synchronizing members 12 and 13 are actuated via the cams 16 and 17, which are directly driven with the rotary speed of the printing machine and guarantees a rotary speed-dependent beginning of movement of the rotary angular motor 13 and the hydraulic cylinder 15.

The proportionality between the oil flow and the regulation speed of the individual motors can be changed via the hydraulic motor inlet element 18, the rotary angular motor inlet element 19, and the hydraulic cylinder inlet element 20, without affecting the relation between the rotary speed of the printing machine and the oil flow. The circuit in the signal processor 7 is an amplifier circuit with a bipolar coefficient. For an output voltage $U_a$ which supplies the flow regulating valve 5, the following is true:

$$U_a=(2m-1)U_3$$

An inlet voltage $U_e$ is supplied from the signal transmitter 6. The bipolar coefficient m can be adjusted between zero and one. In the event of the signal processor without possible inlet via the hydraulic cylinder element 20 the fine adjustment of the potentiometer can be obtained in correspondence with the respective requirements.

The circuit shown in FIG. 2 for the hydraulic cylinder 15 can also be utilized respectively for the rotary angular motor 14 and the hydraulic motor 11. The actuation of the hydraulic motor inlet element, the rotary angular motor inlet element 19 and the hydraulic cylinder inlet element 20 can be performed in a running printing machine. The synchronizing member inlet elements 21 and 22 serve for adjusting the cams 16 and 17. Thereby in the running printing machine the arrangement of the machine rotary angle relative to the movement of the rotary angular motor and the hydraulic cylinder 15 can be optimized in correspondence with the pressure requirements. In the shown example the synchronizing member inlet element 21 and 22 are formed as electromagnetically operating brakes between the machine frame and the rotary cams 16 and 17.

It will be understood that each of the elements described above, or two or more together, may also find a useful application in other types of constructions differing from the types described above.

While the invention has been illustrated and described as embodied in a control system for a printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A control system for a printing machine having a main shaft with a constant ratio of its rotary speed to a drive speed of the printing machine, comprising a plurality of translatorily, continuously rotatably and discontinuously rotatably movable regulating members controllable by a main shaft of the machine; and a single supply system operating by hydraulic energy and associated with said regulating members, said supply system including a fixed displacement pump, an oil supply conduit connecting said fixed displacement pump with said regulating members, an electrically actuated flow regulating valve acting upon an oil stream, and a single transmitter with a signal processor arranged so that said flow regulating valve is connected with the main shaft via said signal processor.

2. A control system as defined in claim 1, wherein said electrically actuated flow regulating valve of said supply system is formed as a flow limiting valve.

3. A control system as defined in claim 1, wherein said flow regulating valve of said supply system is formed as a servo valve.

4. A control system as defined in claim 1; and further comprising a plurality of directional control valves connected with said regulating members, and synchronizing members connected with said directional control valves.

5. A control system as defined in claim 4; and further comprising a plurality of cams arranged on the main shaft, said synchronizing members being coupled with said cams of the main shaft.

6. A control system as defined in claim 1; and further comprising a plurality of input elements associated with said regulating members.

7. A control system as defined in claim 4, and further comprising a plurality of synchronizing member input elements associated with said synchronizing members.

* * * * *